United States Patent [19]

Tsukano et al.

[11] Patent Number: 4,629,309

[45] Date of Patent: Dec. 16, 1986

[54] DEVELOPER SUPPLY SYSTEM FOR DRY PROCESS ELECTROPHOTOGRAPHIC RECORDING APPARATUS

[75] Inventors: Moriyoshi Tsukano, Kawasaki; Hisao Ishizu, Tokyo, both of Japan

[73] Assignee: Ricoh Company, Ltd., Tokyo, Japan

[21] Appl. No.: 674,662

[22] Filed: Nov. 26, 1984

[30] Foreign Application Priority Data

Nov. 24, 1983 [JP] Japan ..... 58-181501[U]
Dec. 28, 1983 [JP] Japan ..... 58-248475

[51] Int. Cl.[4] ..... G03G 21/00

[52] U.S. Cl. ..... 355/3 DD; 141/106; 222/DIG. 1

[58] Field of Search ..... 141/106; 222/DIG. 1; 355/3 DD

[56] References Cited

U.S. PATENT DOCUMENTS 3,618,826 11/1971 Kangas ..... 222/DIG. 1
3,958,878 5/1976 Smith et al. ..... 355/3 DD X
4,218,126 8/1980 Takeichi ..... 222/DIG. 1
4,226,525 10/1980 Sakamoto et al. ..... 222/DIG. 1

FOREIGN PATENT DOCUMENTS 197708 8/1977 Fed. Rep. of Germany ... 222/DIG. 1

*Primary Examiner*—Stephen Marcus
*Assistant Examiner*—Mark Thronson
*Attorney, Agent, or Firm*—Oblon, Fisher, Spivak, McClelland & Maier

[57] ABSTRACT

A developer supply system for a dry process electrophotographic copier supplies a single component or dual component type developer to a developing unit. After a used developer has been discharged from the developing unit, a fresh charge of carrier is supplied to the developing unit and, then, a fresh charge of toner to be mixed with the fresh carrier. A circuit is provided for controlling such a sequence. Independent cylindrical cartridges are allocated to the toner of the single composition developer and to the toner and carrier of the dual composition developer. Each of the cartridges is received in a cylindrical cartridge. The cartridge casing is mounted in a hopper casing associated with the developing unit and is driven for rotation therein.

9 Claims, 5 Drawing Figures

DEVELOPER SUPPLY SYSTEM FOR DRY PROCESS ELECTROPHOTOGRAPHIC RECORDING APPARATUS

BACKGROUND OF THE INVENTION

The present invention relates to an electrophotographic recording apparatus, particularly an electrophotographic copying machine, which is equipped with a dry process developing unit and, more particularly, to a system installed in the recording apparatus for supplying to the developing unit a single composition type developer, i.e. colored magnetic toner particles. The present invention also relates to a system for replacing carrier which is contained in a dual composition type developer, i.e. a mixture of magnetic carrier and non-magnetic toner.

Generally, after a dual composition type developer has been used over a long time in a developing unit of a dry process electrophotographic copier, it loses a sufficient frictional charging property due to fatigue of the carrier and other various causes and comes to require replacement. The replacement has heretofore been accomplished by pulling the developing unit out of a housing of the copier and, then, putting it upside down to remove the used carrier, or by discharging the used carrier by a collecting screw into a container which is placed outside the copier housing, followed by charging a fresh supply of carrier. However, such a prior art procedure of replacement has left various problems unsolved such as scattering of the developer around the copier, inconvenience in respect to disposal of the container, and the need for a special jig for charging a fresh developer, disenabling a user to perform the replacement as desired.

Meanwhile, concerning an electrophotographic copier of the type using a single composition type developer, i.e. magnetic toner, a developer hopper provided with an agitator and a toner bottle are usually placed in the vicinity of a developing unit of the copier so that toner flowing out of the toner bottle may be fed from the developer hopper or toner hopper to the developing unit while being agitated by the agitator. Such a toner supply system is apt to cause the toner to be scattered in and around the copier at each time of supply to smear the copier and the clothes of the user and, in addition, requires an extra space in the toner hopper for the rotation of the agitator, which is detrimental to a small-size design of a copier.

A toner supply system may be provided with a cartridge which has an agitator built thereinside, as disclosed in Japanese Patent Laid-Open Publication No. 56-114969/1981. Although the cartridge with an agitator is effective to reduce the dimensions of a hopper, the agitator-in-cartridge scheme would add to the cost and be unfeasible for a disposal type toner supply system. Further, since toner inside the hopper is directly touched by the bottom of the hopper, it is carried thereby every time the cartridge is replaced with new one, causing contamination of hands and clothes.

SUMMARY OF THE INVENTION

It is therefore an object of the present invention to provide a developer supply sysem for a dry process electrophotographic recording apparatus which allows a developer to be replaced and supplied with ease.

It is another object of the present invention to provide a carrier replacing system which promotes easy replacement of carrier of a dual composition developer in an electrophotographic recording apparatus of the type using such a developer.

It is another object of the present invention to provide a small-sized toner supply system for a dry process electrophotographic recording apparatus of the type using a single composition developer which enables an inexpensive toner cartridge to be used while eliminating the adhesion of toner to the cartridge.

It is another object of the present invention to provide a generally improved developer supply system for a dry process electrophotographic recording apparatus.

In one aspect of the present invention, there is provided a developer replacing system for use with a developing unit which uses a dual composition dry process developer made up of toner and carrier. The system comprises a developer discharging device for discharging the developer from the developing unit, a developer supply device for supplying fresh carrier and fresh toner to the developing unit, and a control device for controlling the developer discharging device and developer supplying device such that after the developer discharging device has discharged the developer from the developing unit, the developer supplying device supplies one of the toner and the carrier to the developing unit and, then, the other.

In accordance with another aspect of the present invention, there is provided a system for supplying a fresh charge of developer to a developing unit which is provided with a hopper casing. The system comprises a cylindrical developer cartridge having a slot for supplying the fresh charge of developer which is stored in the developer cartridge, and a cylindrical cartridge casing having a cartridge insertion opening at one end thereof for inserting the developer cartridge and a slot formed in a periphery thereof to align with the slot of the cartridge which is inserted through the cartridge insertion opening. The cartridge casing is rotatably disposed in the hopper.

In accordance with the present invention, a developer supply system for a dry process electrophotographic copier supplies a single component or dual component type developer to a developing unit. After a used developer has been discharged from the developing unit, a fresh charge of carrier is supplied to the developing unit and, then, a fresh charge of toner to be mixed with the fresh carrier. A circuit is provided for controlling such a sequence. Independent cylindrical cartridges are allocated to the toner of the single composition developer and to the toner and carrier of the dual composition developer. Each of the cartridges is received in a cylindrical cartridge. The cartridge casing is mounted in a hopper casing associated with the developing unit and is driven for rotation therein.

The above and other objects, features and advantages of the present invention will become more apparent from the following detailed description taken with the accompanying drawings.

DESCRIPTION OF THE PREFERRED EMBODIMENTS

While the developer supply system for a dry process electrophotographic recording apparatus of the present invention is susceptible of numerous physical embodiments, depending upon the environment and requirements of use, substantial numbers of the herein shown and described embodiments have been made, tested and used, and all have performed in an eminently satisfactory manner.

Description will first be made of a carrier replacing system for a dual composition type developer in accordance with the present inention.

Figure 1:
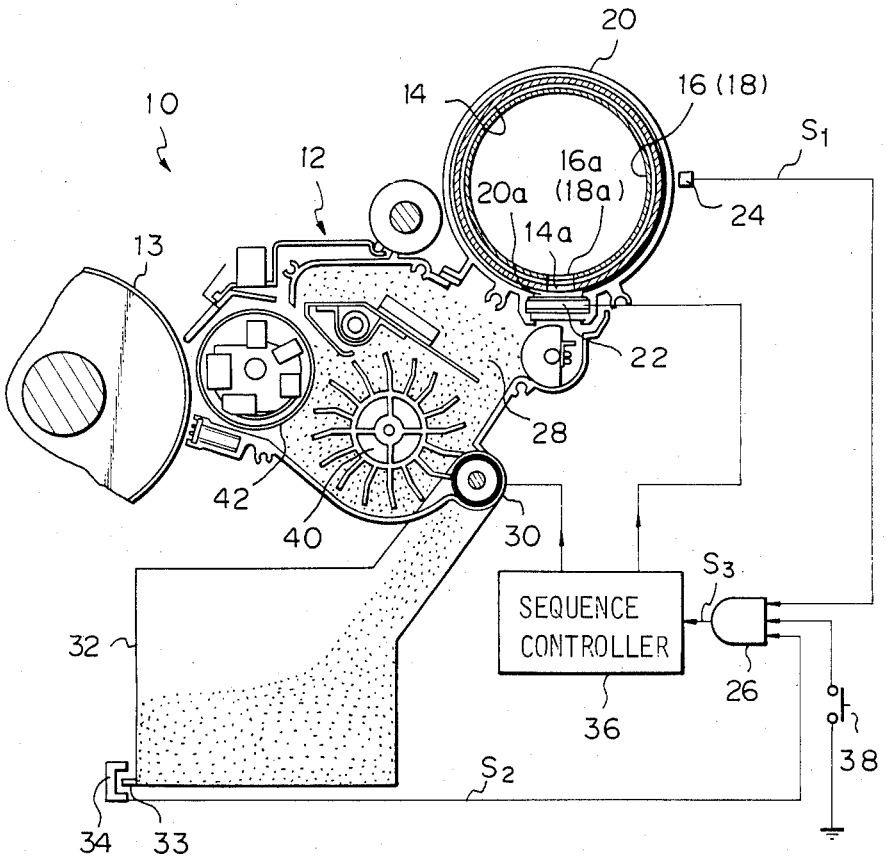
FIG. 1 is a fragmentary vertical section of a dry process electrophotographic recording apparatus to which a carrier replacing system of the present invention is applied.

Referring to FIG. 1, essential parts of a dry process electrophotographic recording apparatus 10 to which one preferred form of the carrier replacing system is applied is shown. The apparatus 10 includes a developing unit 12 and a photoconductive element 13. Disposed above and to the right of the developing unit 12 is a hopper casing 20 which is so configured as to allow a toner cartridge 16 or a carrier cartridge 18 to be selectively inserted therein. The cartridge 16 or 18 is accommodated in a cartridge casing 14. An elongate slot 20*a* extends along the bottom of the hopper casing 20 in a lengthwise direction of the latter. The cartridge casing 14, toner cartridge 16 and carrier cartridge 18 respectively are formed with elongate slots 14*a*, 16*a* and 18*a* each in a position to align with the slot 20*a* of the hopper casing 20. A shutter 22 openably closes the aligned slots and, when opened, provides communication between the cartridge 16 or 18 and the developing unit 12. A photosensor 24 is mounted in part of the hopper casing 20 in order to discriminate the toner cartridge 16 and the carrier cartridge 18, an output signal $S_1$ of the photosensor 24 being routed to one input of a decision gate 26, which may comprise an AND gate, for example. The discrimination between the cartridges 16 and 18 may be implemented by a lug, mark or the like (not shown) provided in part of the periphery of the cartridge casing 14 and to which the photosensor 24 is responsive.

A screw 30 for conveying a developer 28 is located below the developing unit 12 and extends over to a bottle 32 which is removably mounted in a certain position inside the housing of the apparatus 10 suitable for collecting the developer 28. The bottle 32 is provided with a lug 33, mark or the like (not shown) in its periphery, while a sensor 34 is so located as to sense the bottle 10 when the latter is loaded in the apparatus 10 in response to the lug 33 or the like. The output signal $S_2$ of the sensor 34 is applied to the other input of the decision gate 26.

A sequence control circuit 36, in response to an output signal $S_3$ of the decision gate 26, controls the conveyor screw 30 and the shutter 22 such that the used developer 28 is discharged first and, then, a fresh supply of developer is charged in accordance with a predetermined program. The reference numeral 38 in FIG. 1 designates a switch for starting such a developer replacement sequence.

The operation for replacing the developer 28 in the developing unit 12 by means of the above-described system of the present invention will be explained. The operation starts with inserting in the hopper casing 20 the carrier cartridge 18 which has been received in the cartridge casing 14, while placing the bottle 32 in the predetermined position inside the apparatus 10. Then, the start button 38 for developer replacement is depressed. The sensor 24 associated with the hopper casing 20 senses the carrier cartridge 18 and the sensor 34 associated with the bottle mounting section senses the bottle 32. The output signals $S_1$ and $S_2$ of those sensors are delivered to the decision gate 26. In response to the signals $S_1$ and $S_2$, the decision gate 26 is enabled to apply its output $S_3$ to the sequence control circuit, or sequence controller, 36. Then, the sequence controller 36 produces an output to activate the screw 30 for discharging the used developer 28 in the developing unit 12 into the bottle 32 and, upon the lapse of a predetermined period of time which causes the whole developer 28 in the unit 12 to be discharged, opens the shutter 22 so that a fresh supply of carrier is fed into the unit 12 from the carrier cartridge 18.

After the supply of the fresh carrier into the developing unit 12, the carrier cartridge 18 is removed from the hopper casing 20 and, in turn, the toner cartridge 16 is inserted, followed by another start of the system. Then, the shutter 22 is opened again by an output signal of a toner density sensor (not shown), thereby supplying fresh toner from the cartridge 16 to the developing unit 12. The fresh toner is mixed with the previously supplied fresh carrier by the agitator 40 inside the unit 12 to fully condition the unit 12 for development. The toner and carrier mixture is supplied to a developing roller 42 and, thereby, to the surface of the photoconductive element 13.

Figure 2:
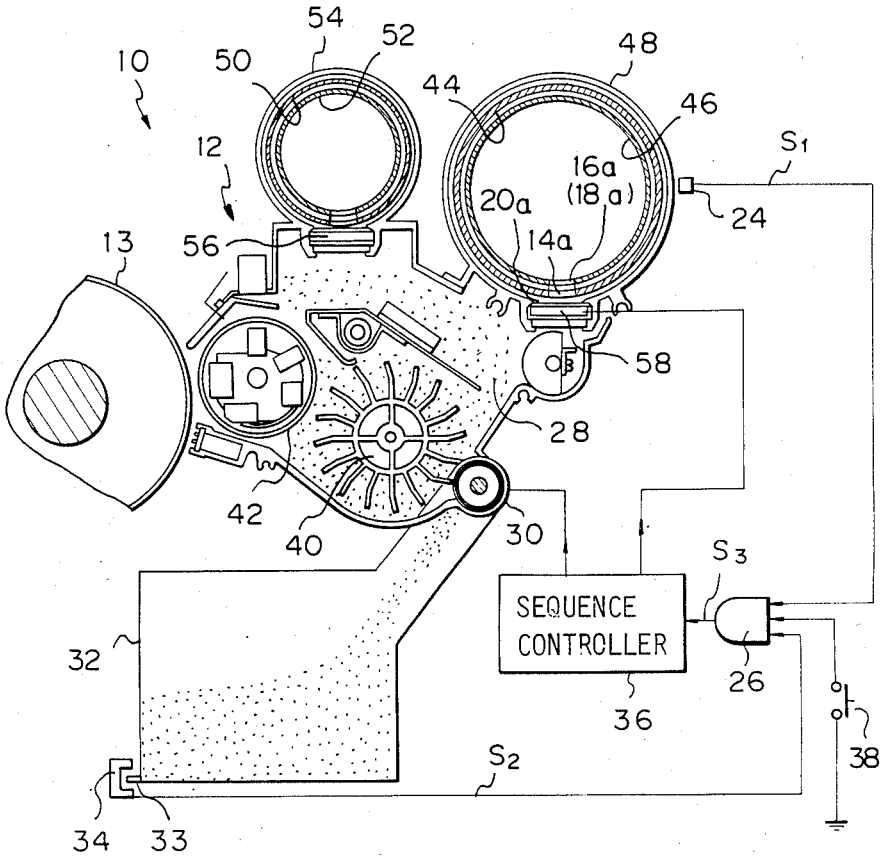
FIG. 2 is a view similar to FIG. 1 but showing another embodiment of the carrier replacing system of the present invention.

Referring to FIG. 2, another embodiment of the carrier replacing system of the present invention is shown. The system includes a first hopper casing 48 located above and to the right of the developing unit 12 for holding a carrier cartridge 46 which is received in a cartridge casing 44, and a second hopper casing 54 also located above the unit 12 for holding a toner cartridge 52 which is received in another cartridge casing 50. A shutter 56 associated with the toner cartridge 52 is actuated by an output of the toner density sensor, while a shutter 58 associated with the carrier cartridge 46 is actuated by an output of the sequence controller 36. The alternative construction shown in FIG. 2 is capable of replacing the carrier in the same manner as the previously described construction. In FIG. 2, the same or similar structural elements as those shown in FIG. 1 are designated by like reference numerals.

As described above, the carrier replacing system shown in FIG. 1 or 2 includes means for supplying fresh carrier to a developing unit and means for removing a used developer from the developing unit, the two means being activated in sequence to discharge the used developer first and, then, to supply fresh carrier. This type of system allows the used developer, or carrier, to be removed easily and automatically with the developing unit kept in its operative position, prevents the developer from being scattered during replacement, and saves time for replacement if the replacement is performed during the course of warm-up operation of the apparatus.

Figure 3:
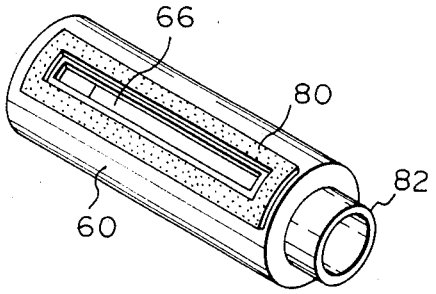
FIGS. 3–5 show a toner supply system in accordance with the present invention.
Figure 4:
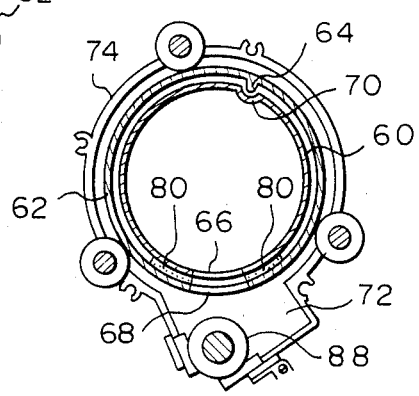
Figure 5:
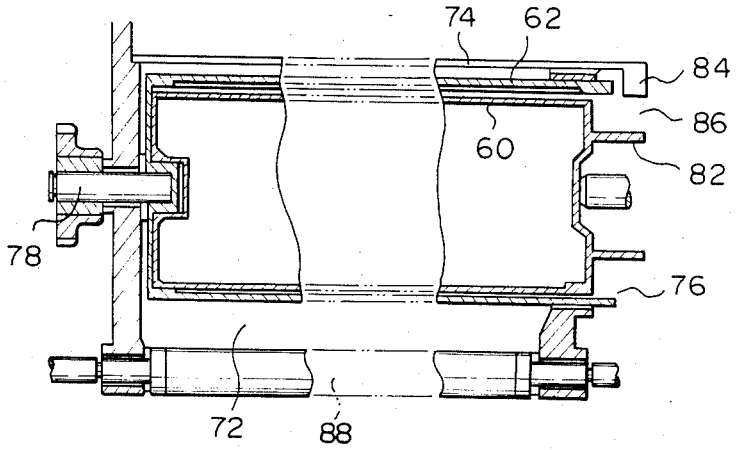

Referring to FIGS. 3–5, a system for supplying a single composition developer, or toner, in accordance with the present invention will be described in detail.

As shown, the system uses a hollow cylindrical toner cartridge 60 which extends substantially over the width of a developing unit (not shown). The toner cartridge 60 is provided with a groove 70 which is to be mated with a positioning ridge 64, which extends on the inner periphery of a cylindrical cartridge casing 62, thereby aligning a toner discharging slot 66 of the cartridge 60 and a toner discharging slot 68 of the casing 62. Before use, the slot 66 of the toner cartridge 60 is closed by a suitable seal member. A hopper casing 74 is disposed above the developing unit to communicate with the latter by way of a toner receiving section 72. The cartridge casing 62 is provided with an opening 76 at one end thereof for insertion of the cartridge 60 and received in the hopper casing 74. The cartridge casing 62 is coupled with a drive shaft 78 to be driven for rotation inside the hopper casing 74.

A sealing member 80 is fit on the toner cartridge 60 to surround the slot 66 for the purpose of isolating the aligned slots 66 and 68 from the ambience. A thumb piece 82 extends from one end of the cartridge 60. A positioning projection 84 is provided over part of the peripheral edge of an opening 86 of the hopper casing 74 which is adapted to insert the cartridge 60, so that the cartridge 60 may be mounted and demounted with the slot 66 facing upward. A supply roller 88 is positioned in the portion which provides communication between the hopper casing 74 and the developing unit.

In use, a seal covering the sot 66 of the toner cartridge 60 is removed. The cartridge casing 62 is so positioned as to align its ridge 64 with the projection 84 located at the opening 86 of the hopper casing 74 and, then, the cartridge 60 is inserted into the casing 62 with its groove 70 mated with the ridge 64. This allows the cartridge 60 to assume an adequate position inside the casing 62 with the slot 66 facing upward.

When the toner supply system is activated, the cartridge 60 coupled with the drive shaft 78 through the casing 62 is rotated to discharge toner through the aligned slots 66 and 68 downwardly into the toner receiving portion 72, while agitating the toner by the projection which is defined by the wall of the inwardly protruding groove 70. In the meantime, the supply roller 88 is rotated by an output of the toner density sensor to sequentially supply the toner into the developing unit. At this instant, even if the toner receiving section 72 is filled with the toner, the toner is prevented from adhering to the cartridge 60 because the cartridge 60 is enclosed in the casing 62. It follows that scattering of the toner is eliminated when the cartridge 60 is removed from the apparatus for replacement by the opposite sequence to the above-described.

Summarizing the toner supply system described above with reference to FIGS. 3–5, a cartridge is received in a cartridge casing which in turn is received in a hopper casing and the cartridge is rotated integrally with the cartridge casing. With such a construction, the system is capable of agitating toner without resorting to a special agitator and attains a remarkably simple and small-size design coupled with the use of ordinary cartridges. In addition, the cartridge casing keeps the peripheral surface of the cartridge out of the toner and, thereby, prevents the recording apparatus, clothes and the like from being smeared by the toner in the event of replacement or the like of the carrier.

Various modifications will become possible for those skilled in the art after receiving the teachings of the present disclosure without departing from the scope thereof. For example, the cartridge 60 and cartridge casing 62 shown in FIGS. 3–5 may be used in place of the cartridge 46 or 50 and the cartridge casing 44 or 50 shown in FIG. 1 or 2.

What is claimed is:

1. A developer replacing system in combination with a developing unit which uses a dual composition dry process developer made up of toner and carrier, comprising:

a developer outlet, developer discharging means having a conveying screw for discharging the developer from the developing unit through the developer outlet, a bottle located in a predetermined position adjacent to said developing unit and communicated with said developer outlet for receiving the discharged developer;

developer supplying means for supplying fresh carrier and fresh toner to the developing unit, comprising:

a toner cartridge for storing said toner and provided with a slot; a carrier cartridge for storing said carrier and provided with a slot; and cartridge casing means formed above and integrally with said developing unit for receiving said toner and carrier cartridges, said cartridge casing means having a slot which aligns with the received toner and carrier cartridge slots;

control means for controlling said developer discharging means and developer supplying means such that after the developer discharging means has discharged the developer from the developing unit, the developer supplying means supplies one of the toner and the carrier to the developing unit and, then, the other and wherein the control means comprises a shutter for selectively opening the slot of the cartridge casing means to provide communication between an interior of any of the cartridges and an interior of the developing unit, a cartridge sensor for discriminating the carrier cartridge and the toner cartridge which are selectively loaded in the cartridge casing, a bottle sensor for sensing whether the bottle is placed in the predetermined position adjacent to the developing unit, and drive means for driving the shutter and screw in response to outputs of the cartridge sensor and bottle sensor.

2. A developer replacing system as claimed in claim 1 wherein the drive means comprises a decision gate means supplied with the outputs of the cartridge sensor and bottle sensor, and a sequence control circuit for controlling the screw and shutter in response to an output of said decision gate means such that in accordance with a predetermined program the screw is activated to discharge the developer from the developing unit into the bottle and, upon the lapse of a predetermined period of time which causes the whole developer to be discharged, the shutter is opened to supply the carrier in the carrier cartridge received in the cartridge casing into the developing unit and, then, the carrier cartridge is replaced with the toner cartridge to supply the toner into the developing unit.

3. A developer replacing system as claimed in claim 2, comprising the drive means further comprises a switch electrically connected to the decision gate means for starting a developer replacing operation.

4. A developer replacing system as claimed in claim 3, wherein the decision gate comprises an AND gate.

5. A developer replacing system as in claim 1 further comprising a hopper; and wherein said developer cartridge is cylindrical in shape with a slot along the curved portion thereof;

and wherein said cartridge casing means has an opening at one end thereof for inserting said developer cartridge such that said developer cartridge can be rotatably disposed therein.

6. A system as claimed in claim 5, wherein the developer cartridge comprises a groove for aligning the slot of the developer cartridge and the slot of the cartridge casing means, the cartridge casing means comprising a ridge to mate with said groove.

7. A system as claimed in claim 5, wherein the developing unit comprises a drive shaft extending into the hopper, the cartridge casing means being coupled with said drive shaft to be rotated thereby.

8. A system as claimed in claim 5, further comprising sealing means positioned along edges of the slot of the developer cartridge for hermetically isolating the aligned slots of the developer cartridge and cartridge casing means from an ambience.

9. A system as claimed in claim 5, wherein the developer cartridge is adapted to store a single composition type developer which comprises magnetic toner.

* * * * *